US010969064B2

(12) United States Patent
Wang et al.

(10) Patent No.: US 10,969,064 B2
(45) Date of Patent: Apr. 6, 2021

(54) LED BULB APPARATUS

(71) Applicant: XIAMEN ECO LIGHTING CO. LTD., Xiamen (CN)

(72) Inventors: Qiyuan Wang, Xiamen (CN); Liangliang Cao, Xiamen (CN); Hongkui Jiang, Xiamen (CN); Wei Liu, Xiamen (CN); Huiwu Chen, Xiamen (CN); Feihua He, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/680,066

(22) Filed: Nov. 11, 2019

(65) Prior Publication Data

US 2020/0149688 A1 May 14, 2020

(30) Foreign Application Priority Data

Nov. 9, 2018 (CN) ..... 201811332257.1

(51) Int. Cl.

| | |
|---|---|
| ***F21K 9/272*** | (2016.01) |
| ***F21V 29/70*** | (2015.01) |
| ***F21K 9/275*** | (2016.01) |
| ***F21K 9/278*** | (2016.01) |

(52) U.S. Cl.

CPC ..... *F21K 9/272* (2016.08); *F21K 9/275* (2016.08); *F21K 9/278* (2016.08); *F21V 29/70* (2015.01)

(58) Field of Classification Search

CPC ..... F21K 9/272; F21K 9/275; F21K 9/278; F21K 9/27; F21V 29/70; F21Y 2115/10

See application file for complete search history.

(56) References Cited

U.S. PATENT DOCUMENTS

| | | | | |
|---|---|---|---|---|
| 10,069,047 | B1 * | 9/2018 | Chen et al. | H01L 33/60 |
| 10,088,142 | B1 * | 10/2018 | McGrath | F21K 9/275 |
| 2013/0141892 | A1 * | 6/2013 | Okazaki | F21V 29/004 362/84 |
| 2014/0312760 | A1 * | 10/2014 | Augustine | F21V 3/02 313/12 |
| 2015/0176770 | A1 * | 6/2015 | Wilcox | F21K 9/272 362/224 |
| 2018/0116030 | A1 * | 4/2018 | Sam | H05B 45/3578 |
| 2018/0206411 | A1 * | 7/2018 | Chen | H01L 25/0753 |

* cited by examiner

*Primary Examiner* — Bao Q Truong

(74) *Attorney, Agent, or Firm* — Chun-Ming Shih; Lanway IPR Services

(57) ABSTRACT

A LED bulb apparatus includes a main body, a light source, two end covers, and two connectors. The main body is a hollow structure. The light source module is disposed inside the main body. The light source module has a base plate, a driver and a light source. The driver and the light source being are mounted on the base plate. The two end covers are fixed on two ends of the main body for closing the hollow structure for forming a closed container for storing the light source module and a heat dissipation gas.

17 Claims, 6 Drawing Sheets

LED BULB APPARATUS

FIELD

The present invention is related to a LED bulb apparatus and more particularly related to a bulb with good heat dissipation.

BACKGROUND

Various light bulb devices are developed and used in different fields. For example, a common light bulb device has an Edison connector to be installed in a corresponding Edison socket.

Some other bulb devices with a light passing shell and operated in larger power ratio for emitting strong light. Such bulb devices have special support bases to be installed and for providing power input.

LED (Light Emitted Diode) is a relatively new technology now widely used in lighting devices. LED provides high efficiency, but it is important to prevent LED components to operate in high temperature environment. Thus, it is important to solve heat problems in LED lighting device design.

In addition, inventors also note that manufacturing cost is also a critical issue. Therefore, it would be beneficial to provide a low cost while reliable design of LED light bulb devices.

SUMMARY OF INVENTION

In one embodiment, a LED bulb apparatus includes a main body, a light source, two end covers and two connectors. The main body is a hollow structure. The light source module is disposed inside the main body.

The light source module includes a base plate, a driver and a light source. The driver and the light source are mounted on the base plate.

The two end covers are fixed on two ends of the main body for closing the hollow structure for forming a closed container for storing the light source module and a heat dissipation gas.

The two connectors respectively have embedded portions partially embedded in the two end covers while exposed portions outside the end covers.

In some embodiments, the main body is a R7 bulb standard shape.

In some embodiments, the main body is made of glass. In some embodiments, the main body is a glass tube.

In some embodiments, the driver includes driver components mounted on the base plate. In some embodiments, the driver components include rectifier diodes disposed on at least one end of the base plate.

In some embodiments, the rectifier diodes are both ends of the base plate.

In some embodiments, the two end covers are made of a same glass material as the main body and are pressed to conceal the main body during manufacturing.

In some embodiments, the LED bulb apparatus also includes two conductive wires on two ends of the base plate. The two conductive wire are partly embedded in the end cover and partly exposed outside the end cover for connecting to an external power source.

In some embodiments, the conductive wires are Dumet wires.

In some embodiments, the LED bulb apparatus also includes an exhaust tube for installing the heat dissipation gas while manufacturing and concealed after the heat dissipation gas being installed.

In some embodiments, the exhaust tube is made of a same glass material as the main body.

In some embodiments, the exhaust tube has a melt end by melting the exhaust tube while concealing the main body.

In some embodiments, the LED bulb apparatus also includes a temperature sensor for detecting an operation temperature of the light source module.

In some embodiments, the driver adjusts a driving current supplied to the light source module by reference to the operation temperature detected by the temperature sensor.

In some embodiments, a fluorescent layer is covered on both the light source and the driver.

In some embodiments, a heat dissipation material is mixed in the fluorescent layer. In addition, the heat dissipation material may be metal powder like copper, silver with reflective characteristics. Such metal powder may help heat dissipation and also increase light effect.

In some embodiments, the two end covers are plastic piece attached to the main body with glue.

In some embodiments, the two end covers have metal pins embedded in the two end covers for connecting the driver to an external power source.

DETAILED DESCRIPTION

In one embodiment, a LED bulb apparatus includes a main body, a light source, two end covers and two connectors. The main body is a hollow structure. The light source module is disposed inside the main body.

The light source module includes a base plate, a driver and a light source. The driver and the light source are mounted on the base plate.

The two end covers are fixed on two ends of the main body for closing the hollow structure for forming a closed container for storing the light source module and a heat dissipation gas.

The two connectors respectively have embedded portions partially embedded in the two end covers while exposed portions outside the end covers.

Figure 1:
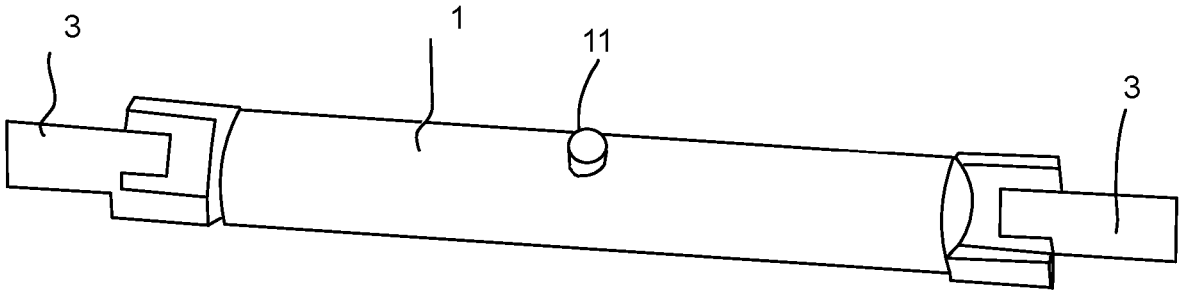
FIG. 1 is a partial perspective view of a bulb.
Figure 2:
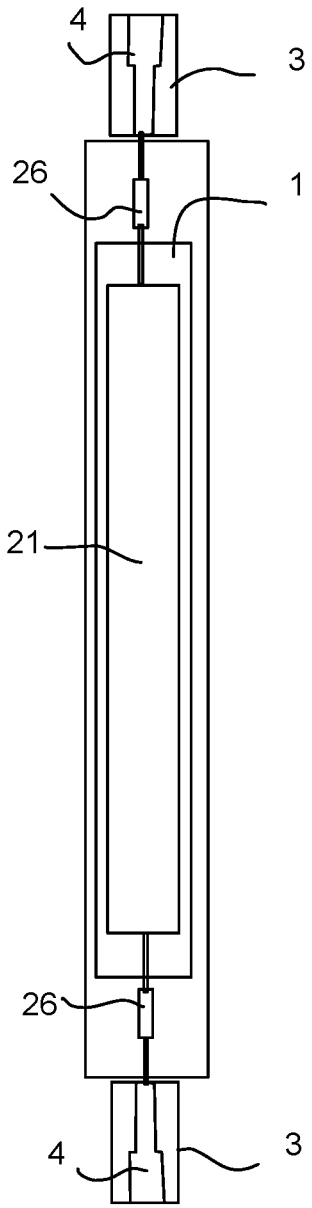
FIG. 2 is a partial cross sectional view of the bulb.
Figure 3:
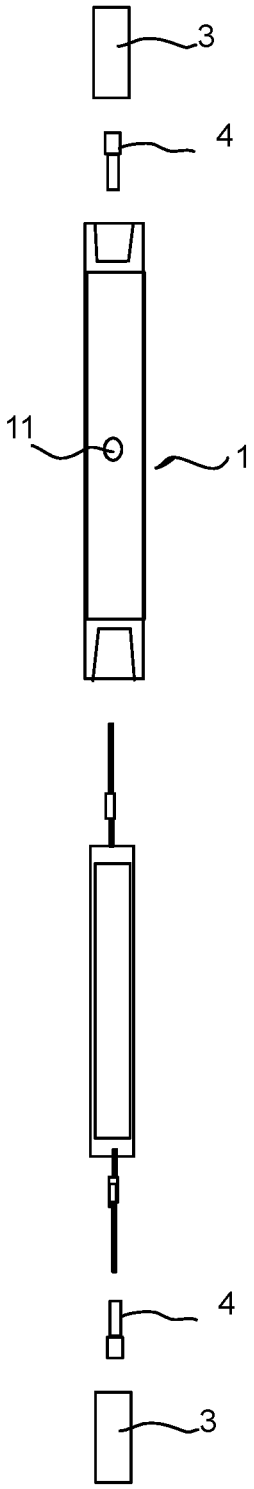
FIG. 3 is a partial exploded view of the bulb.

Please refer to FIG. 1 to FIG. 3. A bulb includes a main body 1, a light source module 2, an end cover 3, and a connector 4. Then, the main body 1 may be a hollow structure. The light source module may be set inside of the main body 1. The light source module 2 includes a base plate 21, a driver 22, and a light source. The driver 22 and the light source may be set on a base plate 21. An end cover may be connected to the two ends of the main body 1. The connector 4 may be set inside of the end cover 3. The connector 4 is electrically connected to the base plate 21. The base plate 21 receives external signal via the connector 4. In some embodiments, two ends of the main body 1 include the end cover 3 and the connector 4.

The bulb doesn't have a traditional driver plate by integrating the driver and the driver 22 into the light source module 2. Therefore, the bulb has less weight, better heat dissipation, better assembly efficiency, less manufacturing cost, and then greater competitiveness.

In practical application, the bulb is one of the R7s bulb products. Compared with most of the LED R75, the R75 bulb has better heat dissipation and higher overall performance. Other than that, the R75 bulb doesn't include a heat dissipation piece, driver plate, or other conventional components. In manufacture, the design may have better assembly efficiency, less overall manufacturing cost, higher overall revenue, and greater core competence.

In some embodiments, the main body is a R7 bulb standard shape.

In one embodiment, the main body 1 may be in an elongated shape. To be specific, the main body 1 is a glass tube. In other embodiments, the main body may be made from other transparent materials and in other shapes.

Figure 7:
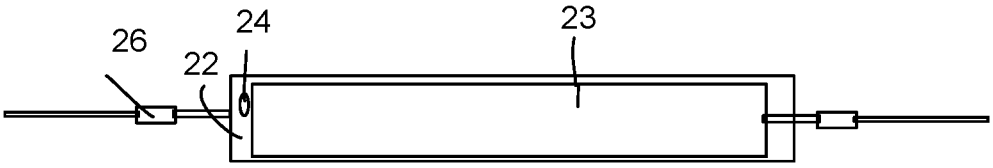
FIG. 7 is a partial structural view of the light source module.
Figure 8:
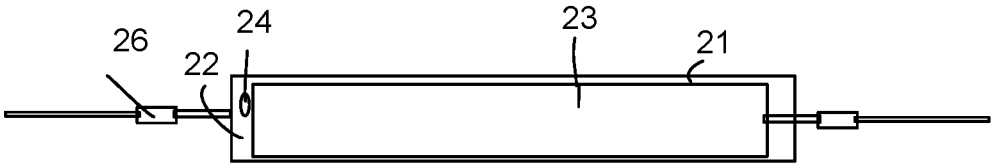
FIG. 8 is another partial structural view of the light source module.
Figure 9:
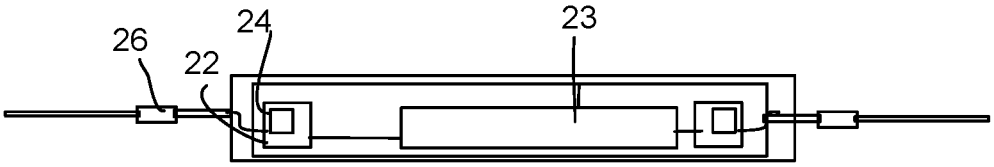
FIG. 9 is an electrical diagram of the light source module.

Please refer to FIG. 7 to FIG. 9. In one embodiment, the light source may be set in a LED array on the two sides of the base plate. In the embodiment, the LEDs 23 in the LED array may be connected in series or connected in parallel. The driver 22 is electrically connected to the LED 23 and drives the LED array to illuminate. In practical application, the number of the LEDs 23 may differ according to the real situation.

In one embodiment, the light source module 2 includes multiple rectifier diodes 24 on the base plate 21. The rectifier 24 is electrically connected to the driver 22 and the LED 23 respectively. In the embodiment, there are 4 rectifier diodes and four bridge rectifiers made from rectifier diodes 24. Then the bridge rectifiers convert the input alternating current into direct current. Please refer to FIG. 7. The four rectifier diodes may be set on two ends of the base plate 21 respectively. In other words, each end of the base plate 21 includes two rectifier diodes 24. The driver 22 may be set on one end of the base plate 21.

Please refer to FIG. 8. In another embodiment, four rectifier diodes may be set on one end of the base plate 21. The driver 22 may be set on the base plate 21's one end away from the rectifier diodes 24. In other words, the rectifier diodes 24 and the driver 22 may be set on two ends of the base plate 21 respectively.

In some embodiments, the main body is made of glass. In some embodiments, the main body is a glass tube.

In some embodiments, the driver includes driver components mounted on the base plate. In some embodiments, the driver components include rectifier diodes disposed on at least one end of the base plate.

In some embodiments, the rectifier diodes are both ends of the base plate.

In some embodiments, the two end covers are made of a same glass material as the main body and are pressed to conceal the main body during manufacturing.

In some embodiments, the LED bulb apparatus also includes two conductive wires on two ends of the base plate. The two conductive wire are partly embedded in the end cover and partly exposed outside the end cover for connecting to an external power source.

In some embodiments, the conductive wires are Dumet wires.

In some embodiments, the LED bulb apparatus also includes an exhaust tube for installing the heat dissipation gas while manufacturing and concealed after the heat dissipation gas being installed.

Figure 4:
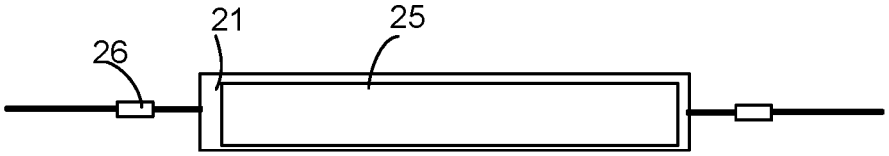
FIG. 4 is a top view of a light source module.
Figure 5:
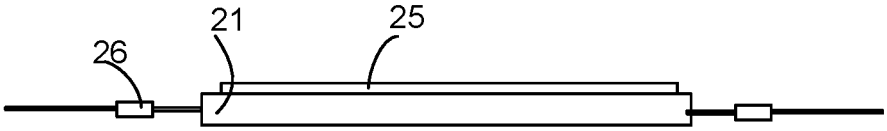
FIG. 5 is a side view of the light source module.

Please refer to FIG. 4, FIG. 5, and FIG. 9. In one embodiment, the LED 23 may be an unpackaged diode die. And the rectifier diode 24 may be an unpackaged diode die. In the embodiment, the light source module 2 includes a fluorescent layer 25 disposed at two sides of the base plate 21. The fluorescent layer 25 may be used in the unpackaged LED die, the unpackaged diode die, and the driver 22. The design may increase the heat dissipation efficiency and the assembly efficiency. In the embodiment, the fluorescent layer 25 on two sides of the base plate 21 is disposed symmetrically to the base plate 21. And the fluorescent layer 25 may be set close to the case plate 21. In practical application, the fluorescent layer 25 includes one or multiple kinds of fluorescent materials that may emit red light, green light, or blue light under energy excitation.

Please refer to FIG. 9. In one embodiment, the driver 22 includes a temperature sensor resistor. The temperature sensor resistor may be for converting the temperature increasing signal into electrical signal. In the embodiment, the operation of the electronic diagram of the bulb is as follows. External power source may be inputted via the L line 101 (phase line) at one end of the base plate 21. And then, the alternating current may be converted into direct current when passing through the rectifier bridge composed of four rectifier diodes 24. The driver 22 may drive the LED 23 to illuminate. When detected temperature is too high, the temperature sensor resistor in the driver 22 may change resistor value to decrease the current in a circuit diagram to lower power efficiency. In the end, the current may be outputted to ground via a N line 102 (ground line) at the other end of the base plate 21.

In one embodiment, the light source module 2 includes a conductive line 26. One end of the conductive line 26 may be connected to the base plate 21. The other end may be connected to the connector 4. In the embodiment, one end of the conductive line 26 is welded to the base plate 21. The other end of the conductive line 26 passes through the main body 1 and then is connected to the connector 4. Preferably, the conductive line 26 includes a Dumet wire and a Nickel wire. And the thermal expansion coefficient of the Dumet wire is almost the same as that of glass, which may ensure the packaging yield rate and long-term reliable vacuum quality.

In practical application, the conductive line 26 is made from three different materials. The three different materials include an inner conductive wire, an external conductive wire, and a Dumet wire. The inner conductive wire is the part that is exposed inside of a glass main body. The external conductive wire is the part that is outside of the glass main body and connected to the connector 4. The Dumet wire is the part that is melted seal with the glass main body. In welding, generally, the inner conductive wire, the external conductive wire, and the Dumet wire are welded together into the conductive line 26 with Hydrogen oxide flame or electrical arc. Then, generally, the inner conductive wire and the external conductive wire are made from Nickel wire.

In one embodiment, the main body 1 includes an exhaust tube 11. The exhaust tube is a hollow structure and connected to the main body 1. In the embodiment, the exhaust tube 11 may be for air discharging and charging for the main body 1. In practical application, the exhaust tube 11 is a glass tube. The exhaust tube 11 and the main body 1 are integrated as one piece in order to simplify the structure and reduce cost.

In one embodiment, the end cover 3 and the main body 1 are fixed by using glue. Practically, the end cover and the end of the main body 1 may be fixed together manually or by air driven or electrical gluing. Other than that, using glue to fix is simple and convenient for sealing the main body 1. In other embodiments, the end cover 3 and the end of the main body 1 may be fixed by other methods.

In one embodiment, the main body 1 may be charged with inert gas. The inert gas may be at least one of Helium, Neon, Argon, Krypton, Xenon, and Radon. And the top choice is Helium.

In practical application, first discharge the air from the main body 1 with the exhaust tube 11. Then, insert the Helium with the exhaust tube 11.

Figure 6:
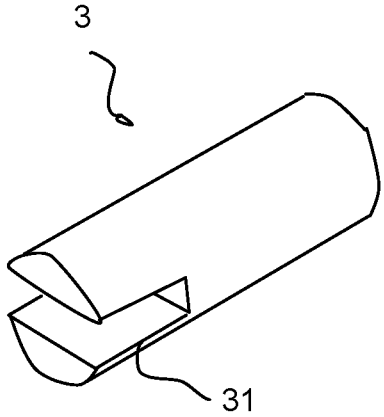
FIG. 6 is a perspective view of an end cover.

Please refer to FIG. 6. In one embodiment, the end of the cover end 3 connected to the main body 1 includes a concave groove 31. The end of the main body 1 is clipped in the concave groove 31 in order to connect the end cover 3 and the main body 1. In practical application, the end of the main body 1 is heated to melt status. Then the melt portion of the main body 1 is flattened with a clamp. Then the main body 1 may be clipped in the concave groove 31 when the main body is cooled. Then, the concave groove 31 has a predetermined depth in the axial direction along the end cover 3. And the concave groove 31 goes through the end cover 3 in the radial direction along the end cover 3.

Other than that, an end away from the main body 1 of the end cover 3 includes an insertion hole. The insertion hole is for plugging connector 4. The insertion hole and the connector 4 have matching shape. In addition, the insertion hole is connected to the concave groove 31 to insert the conductive line 26 into the insertion hole and help the conductive line 26 connect to the connector 4 in the insertion hole. In practical application, the end cover 3 is not limited to use transparent material as material. For example, the end cover 3 may use ceramic or nontransparent plastic material as material. And transparent material may be transparent plastic material. The connector 4 is a copper pin. One end of the copper pin is inserted into the insertion hole and abuts one end surface of the main body 1. The other end of the copper pin aligns the end surface of the transparent plastic piece. The copper pin includes an opening hole. The end away from the base plate 21 of the conductive line extends into the opening hole and is fixed connection with the end away from the main body 1 of the copper pin.

In some embodiments, the exhaust tube is made of a same glass material as the main body.

In some embodiments, the exhaust tube has a melt end by melting the exhaust tube while concealing the main body.

In some embodiments, the LED bulb apparatus also includes a temperature sensor for detecting an operation temperature of the light source module.

In some embodiments, the driver adjusts a driving current supplied to the light source module by reference to the operation temperature detected by the temperature sensor.

In some embodiments, a fluorescent layer is covered on both the light source and the driver.

In some embodiments, a heat dissipation material is mixed in the fluorescent layer. In addition, the heat dissipation material may be metal powder like copper, silver with reflective characteristics. Such metal powder may help heat dissipation and also increase light effect.

In some embodiments, the two end covers are plastic piece attached to the main body with glue.

In some embodiments, the two end covers have metal pins embedded in the two end covers for connecting the driver to an external power source.

The specific method for assembling a bulb mentioned above is as follow.

S1. Provide a main body 1, a light source module 2, an end cover 3, and a connector 4. Then, the light source module 2 includes a base plate, a driver 22, a light source, and a conductive line 26. The driver 22 and the light source are set on the base plate 21. One end of the conductive line 26 is connected to the base plate 21.

S2. Insert the light source module 2 into the main body 1 and heat the two ends of the main body 1 to melt status to make the conductive line 26 and the main body 1 melt together.

S3. Flatten the melt portion of the main body 1 with a clamp. Integrate the main body 1 and the light source module 2 as one piece after the main body is cooled.

S4. The main body 1 includes an exhaust tube 11. Discharge the air from the main body 1 with the exhaust tube 11. Then, charge the inert gas.

S5. Break the extra part of the exhaust tube 11. Seal the exhaust opening of the exhaust tube 11.

S6. Use glue to fix the end cover 3 and the main body 1.

S7. Insert the connector 4 into the end cover 3.

In practical application, the main body 1 is a glass main body. The end cover 3 is a transparent plastic piece. The connector 4 is a copper pin. The conductive line 26 includes a Dumet wire and a Nickel wire.

What needs to be understood is that the number of the step sequence doesn't indicate that the process should be performed in that sequence. The performing sequence of every process may differ based on actual manufacturing process and may not put any limit on the performing process. Between any two steps of making the bulb may include any other steps which don't affect the performance of the technical proposal of the bulb.

Figure 10:
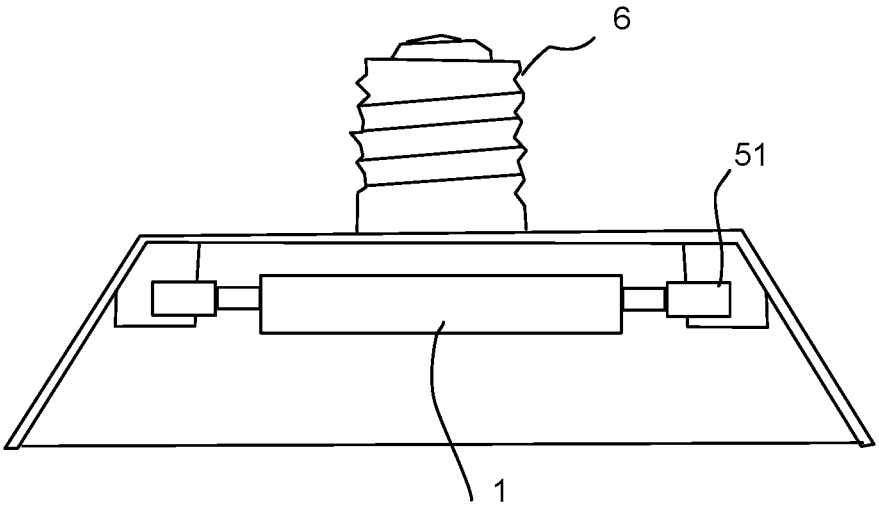
FIG. 10 is a side view of a lighting fixture.

Please refer to FIG. 10. The bulb includes a lighting apparatus. The lighting apparatus includes an external shell 5, a light head 6, and the bulb mentioned above. Then, the light head 6 may be set at one end of the external shell 5. The bulb may be set inside of the external shell 5. In one embodiment, the external shell 5 has an opening at one end. The light head 6 is fixed connection to the other end away from the opening of the external shell 5. The bulb may be fixed inside of the opening. In practical application, the external shell 5's inner wall at two sides includes respective installation parts 51. The end covers 3 at two ends of the main body 1 are connected to the installation parts 51 respectively. Preferably, the installation part 51 and the external shell 5 are integrated as one piece to simplify manufacturing and reduce manufacturing cost.

The above-mentioned embodiments may solve one or more technical problems due to their respective technical feature(s). Although various embodiments of the invention have been described above with a certain degree of particularity, or with reference to one or more individual embodiments, those with ordinary skill in the art could make numerous alterations to the disclosed embodiments, such as the addition or deletion of one or more elements, without departing from the spirit or scope of this invention.

The invention claimed is:

1. A LED bulb apparatus comprising:

a main body, being a hollow structure;

a light source module disposed inside the main body, the light source module comprising a base plate, a driver and a light source, the driver and the light source being mounted on the base plate;

two end covers fixed on two ends of the main body for closing the hollow structure for forming a closed container for storing the light source module and a heat dissipation gas; and two connectors respectively having embedded portions partially embedded in the two end covers while exposed portions outside the end covers, wherein a fluorescent layer covers both the light source and the driver.

2. The LED bulb apparatus of claim 1, wherein the main body is a R7 bulb standard shape.

3. The LED bulb apparatus of claim 1, wherein the main body is made of glass.

4. The LED bulb apparatus of claim 3, wherein the main body is a glass tube.

5. The LED bulb apparatus of claim 1, wherein the driver comprises driver components mounted on the base plate.

6. The LED bulb apparatus of claim 5, wherein the driver components comprise rectifier diodes disposed on at least one end of the base plate.

7. The LED bulb apparatus of claim 6, wherein the rectifier diodes are both ends of the base plate.

8. The LED bulb apparatus of claim 1, wherein the two end covers are made of a same glass material as the main body and are pressed to conceal the main body during manufacturing.

9. The LED bulb apparatus of claim 1, further comprising two conductive wires on two ends of the base plate, the two conductive wire being partly embedded in the end cover and partly exposed outside the end cover for connecting to an external power source.

10. The LED bulb apparatus of claim 9, wherein the conductive wires are Dumet wires.

11. The LED bulb apparatus of claim 1, further comprising an exhaust tube for installing the heat dissipation gas while manufacturing and concealed after the heat dissipation gas being installed.

12. The LED bulb apparatus of claim 11, wherein the exhaust tube is made of a same glass material as the main body.

13. The LED bulb apparatus of claim 1, wherein the driver adjusts a driving current supplied to the light source module by reference to the operation temperature detected by the temperature sensor.

14. The LED bulb apparatus of claim 1, wherein a heat dissipation material is mixed in the fluorescent layer.

15. The LED bulb apparatus of claim 14, wherein the heat dissipation material is metal powder.

16. The LED bulb apparatus of claim 1, wherein the two end covers are plastic piece attached to the main body with glue.

17. The LED bulb apparatus of claim 1, wherein the two end covers have metal pins embedded in the two end covers for connecting the driver to an external power source.

* * * * *